US006782865B2

(12) United States Patent
Rayl et al.

(10) Patent No.: US 6,782,865 B2
(45) Date of Patent: Aug. 31, 2004

(54) METHOD AND APPARATUS FOR CONTROL OF A VARIABLE DISPLACEMENT ENGINE FOR FUEL ECONOMY AND PERFORMANCE

(75) Inventors: Allen B. Rayl, Waterford, MI (US); Gregory Paul Matthews, West Bloomfield, MI (US)

(73) Assignee: General Motors Corporation, Detroit, MI (US)

( * ) Notice: Subject to any disclaimer, the term of this patent is extended or adjusted under 35 U.S.C. 154(b) by 49 days.

(21) Appl. No.: 10/104,111

(22) Filed: Mar. 22, 2002

(65) Prior Publication Data

US 2002/0170527 A1 Nov. 21, 2002

Related U.S. Application Data

(60) Provisional application No. 60/292,156, filed on May 18, 2001.

(51) Int. Cl.[7] ..... F02B 77/00
(52) U.S. Cl. ..... 123/198 F
(58) Field of Search ..... 123/198 F, 481, 123/480, 118.1; 73/118.1

(56) References Cited

U.S. PATENT DOCUMENTS

| | | | | |
|---|---|---|---|---|
| 4,305,355 | A | * 12/1981 | Jordan | 123/198 F |
| 5,568,795 | A | 10/1996 | Robichaux et al. | 123/198 F |
| 5,721,375 | A | * 2/1998 | Bidner | 73/118.1 |
| 5,826,563 | A | * 10/1998 | Patel et al. | 123/481 |
| 6,209,526 | B1 | * 4/2001 | Sun et al. | 123/481 |
| 6,499,449 | B2 | * 12/2002 | Michelini et al. | 123/90.15 |
| 6,585,621 | B2 | * 7/2003 | Matthews et al. | 477/115 |

* cited by examiner

*Primary Examiner*—Tony M. Argenbright
*Assistant Examiner*—Hyder Ali
(74) *Attorney, Agent, or Firm*—Christopher DeVries

(57) ABSTRACT

An engine control system in a vehicle including a variable displacement internal combustion engine, an intake manifold coupled to the variable displacement internal combustion engine, a controller for controlling the displacement of the variable displacement internal combustion engine, a pressure sensor sensing manifold pressure, the pressure sensor electronically coupled to the controller, and where the controller receives pressure information from the pressure sensor and changes the displacement of the variable displacement internal combustion engine in response to the pressure information.

11 Claims, 5 Drawing Sheets

METHOD AND APPARATUS FOR CONTROL OF A VARIABLE DISPLACEMENT ENGINE FOR FUEL ECONOMY AND PERFORMANCE

This application claims priority from U.S. Provisional Application No. 60/292,156 filed May 18, 2001.

TECHNICAL FIELD

The present invention relates to the control of internal combustion engines. More specifically, the present invention relates to a method and apparatus to control a variable displacement internal combustion engine.

BACKGROUND OF THE INVENTION

Present regulatory conditions in the automotive market have led to an increasing demand to improve fuel economy and reduce emissions in present vehicles. These regulatory conditions must be balanced with the demands of a consumer for high performance and quick response for a vehicle. Variable displacement internal combustion engines (ICEs) provide for improved fuel economy and torque on demand by operating on the principal of cylinder deactivation. During operating conditions that require high output torque, every cylinder of a variable displacement ICE is supplied with fuel and air to provide torque for the ICE. During operating conditions at low speed, low load, and/or other inefficient conditions for a fully displaced ICE, cylinders may be deactivated to improve fuel economy for the variable displacement ICE and vehicle. For example, in the operation of a vehicle equipped with an eight cylinder variable displacement ICE, fuel economy will be improved if the ICE is operated with only four cylinders during low torque operating conditions by reducing throttling losses. Throttling losses, also known as pumping losses are the extra work than an ICE must perform to pump air from the relatively low pressure of an intake manifold, across a throttle body or plate, through the ICE and out to the atmosphere. The cylinders that are deactivated will not allow air flow through their intake and exhaust valves, reducing pumping losses by forcing the ICE to operate at a higher intake manifold pressure. Since the deactivated cylinders do not allow air to flow, additional losses are avoided by operating the deactivated cylinders as "air springs" due to the compression and decompression of the air in each deactivated cylinder.

In past variable displacement ICEs, the switching between a partially displaced and fully displaced operating condition for a variable displacement internal combustion engine was problematic due to the disturbances associated with varying the displacement of the ICE.

SUMMARY OF THE INVENTION

The present invention is a method and apparatus for the control of cylinder deactivation in a variable displacement engine. In the preferred embodiment of the present invention, an eight-cylinder internal combustion engine (ICE) may be operated as a four-cylinder engine by deactivating four cylinders. The cylinder deactivation occurs as a function of load or torque demand by the vehicle. Torque reserve can be estimated using vacuum pressure determined by subtracting engine manifold pressure from the barometric pressure. As seen in FIG. 1, there is a generally linear relationship between vacuum pressure and reserve engine torque. An engine or power train controller will monitor vacuum pressure and determine if the ICE should enter four-cylinder mode. If the ICE is in a condition where it can deliver the desired torque with partial displacement to improve efficiency, the controller will deactivate the mechanisms operating the valves for the selected cylinders and also shut off fuel to the selected cylinders. The deactivated cylinders will thus function as air springs.

Fuel economy for a variable displacement ICE is maximized by operating in a partially displaced mode or configuration. The present invention maximizes the amount of time spent in a partially displaced operation while maintaining the same performance and driveability of a fully displaced ICE. Fuel economy improvement is maximized by entering a partially displaced configuration as quickly as possible, and staying in the partially displaced configuration for as long as possible in the operation of a variable displacement ICE. To make the change from variable to full displacement imperceptible to the driver, the ICE must be able to maintain some torque reserve when partially displaced (as detected by vacuum) to allow the generation of any additional torque that may be requested during the time delay of a switching cycle. The switching cycle requires approximately 1000 engine crank degrees during a change from partial to full displacement or vice versa. Continued switching or cycling (busyness) between partial and full displacement should also be reduced as it will compromise fuel economy and emissions for a variable displacement ICE.

The present invention reduces the busyness of operating mode switching or cycling by monitoring the amount of time operating with partial displacement. Busyness is detected if this partial displacement operating time does not exceed a calibrated time, and a non-busy condition is detected if the operating time exceeds a second calibrated time. When operating conditions that generate busyness are detected, the vacuum threshold to switch to partial displacement is incremented by a calibration value to decrease the potential for cycling. Whenever a non-busy condition is detected, the threshold is reduced by a calibrated amount. This allows the system to quickly increase the threshold to reduce cycling and slowly reduce the threshold when busyness is not detected.

DESCRIPTION OF THE PREFERRED EMBODIMENT

Figure 1:
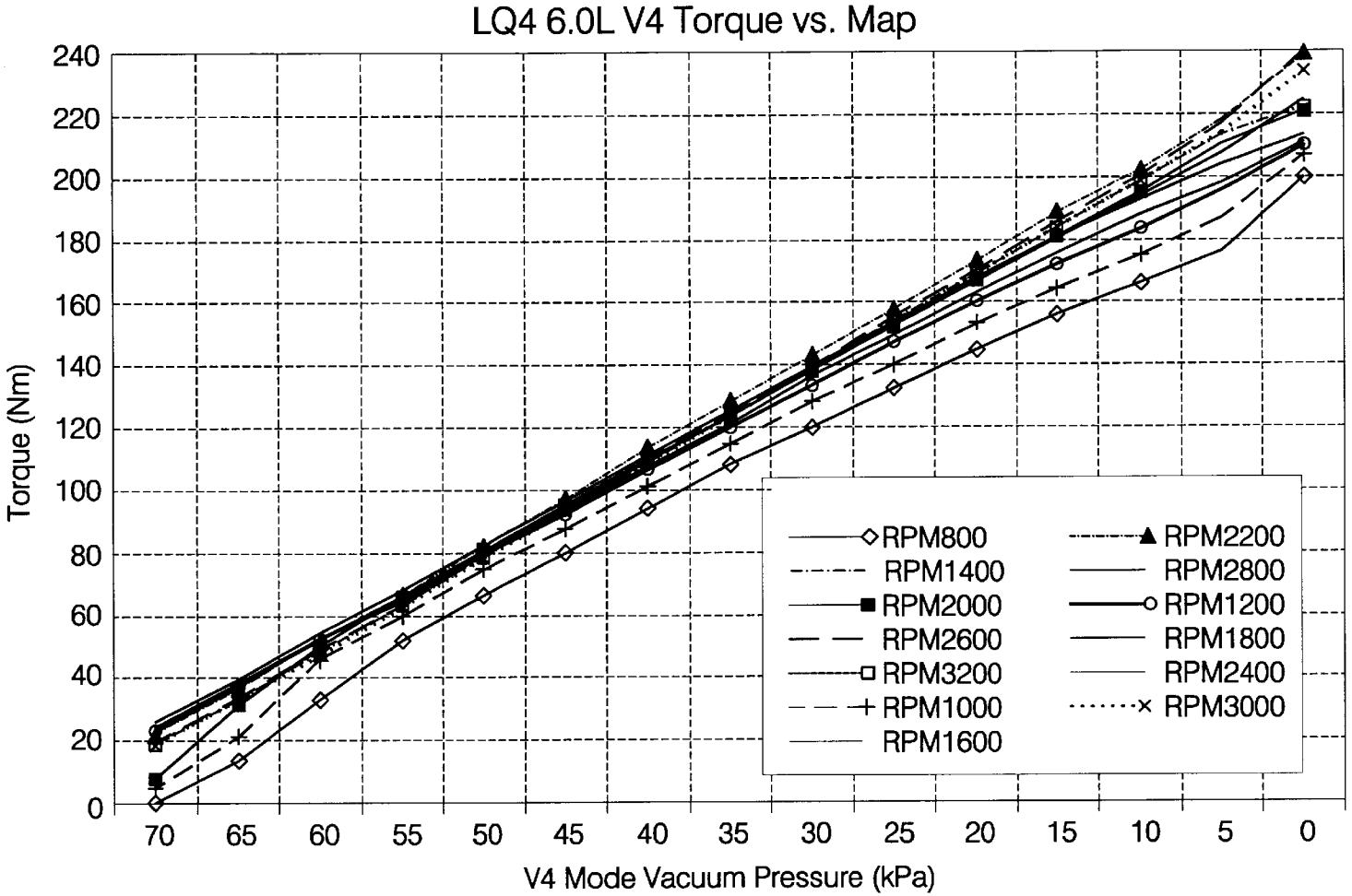
FIG. 1 is a torque versus manifold pressure graph.
Figure 2:
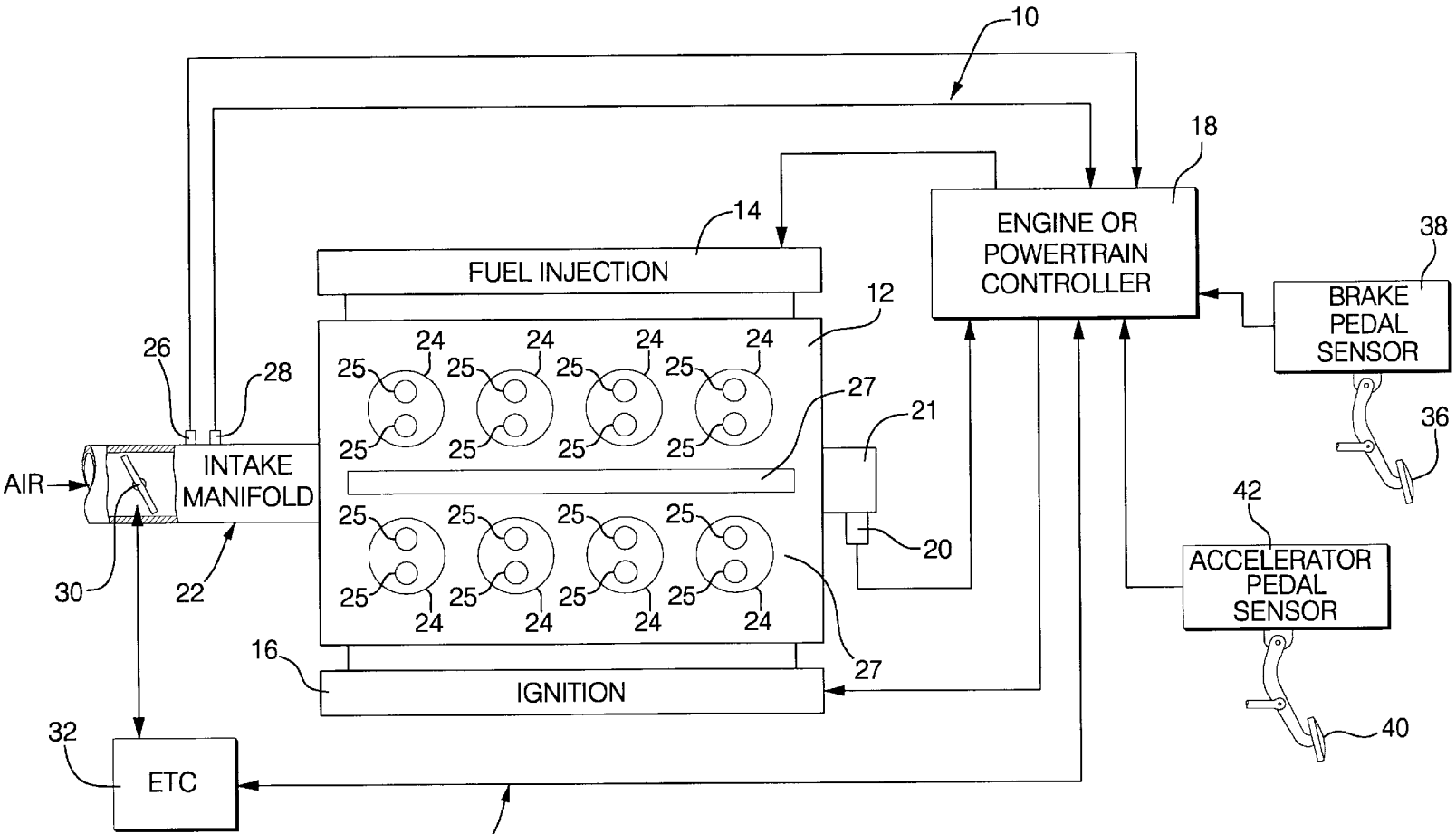
FIG. 2 is a diagrammatic drawing of the control system of the present invention.

FIG. 2 is a diagrammatic drawing of the vehicle control system 10 of the present invention. The control system 10 includes a variable displacement ICE 12 having fuel injectors 14 and spark plugs 16 (in the case of a gasoline engine) controlled by an engine or powertrain controller 18. The ICE 12 crankshaft 21 speed and position are detected by a speed and position detector 20 that generates a signal such as a pulse train to the engine controller 18. The ICE 12 may comprise a gasoline ICE or any other ICE known in the art. An intake manifold 22 provides air to the cylinders 24 of the ICE 10, the cylinders having valves 25. The valves 25 are further coupled to an actuation apparatus such as used in an overhead valve or overhead cam engine configuration that may be physically coupled and decoupled to the valves 25 to shut off air flow through the cylinders 24. An air flow sensor 26 and manifold air pressure (MAP) sensor 28 detect the air flow and air pressure within the intake manifold 22 and generate signals to the powertrain controller 18. The airflow sensor 26 is preferably a hot wire anemometer and the MAP sensor 28 is preferably a strain gauge.

An electronic throttle 30 having a throttle plate controlled by an electronic throttle controller 32 controls the amount of air entering the intake manifold 22. The electronic throttle 30 may utilize any known electric motor or actuation technology in the art including, but not limited to, DC motors, AC motors, permanent magnet brushless motors, and reluctance motors. The electronic throttle controller 32 includes power circuitry to modulate the electronic throttle 30 and circuitry to receive position and speed input from the electronic throttle 30. In the preferred embodiment of the present invention, an absolute rotary encoder is coupled to the electronic throttle 30 to provide speed and position information to the electronic throttle controller 32. In alternate embodiments of the present invention, a potentiometer may be used to provide speed and position information for the electronic throttle 30. The electronic throttle controller 32 further includes communication circuitry such as a serial link or automotive communication network interface to communicate with the powertrain controller 18 over an automotive communications network 33. In alternate embodiments of the present invention, the electronic throttle controller 32 may be fully integrated into the powertrain controller 18 to eliminate the need for a physically separate electronic throttle controller.

A brake pedal 36 in the vehicle is equipped with a brake pedal sensor 38 to determine the amount of pressure generated by an operator of the vehicle on the brake pedal 36. The brake pedal sensor 36 generates a signal to the powertrain controller 18 to determine a braking condition for the vehicle. A braking condition will indicate a low torque/low demand condition for the variable displacement ICE 12. An accelerator pedal 40 in the vehicle is equipped with a pedal position sensor 42 to sense the position of the accelerator pedal. The pedal position sensor 42 signal is also communicated to the powertrain controller 18. In the preferred embodiment of the present invention, the brake pedal sensor 38 is a strain gauge and the pedal position sensor 42 is an absolute rotary encoder.

Figure 3:
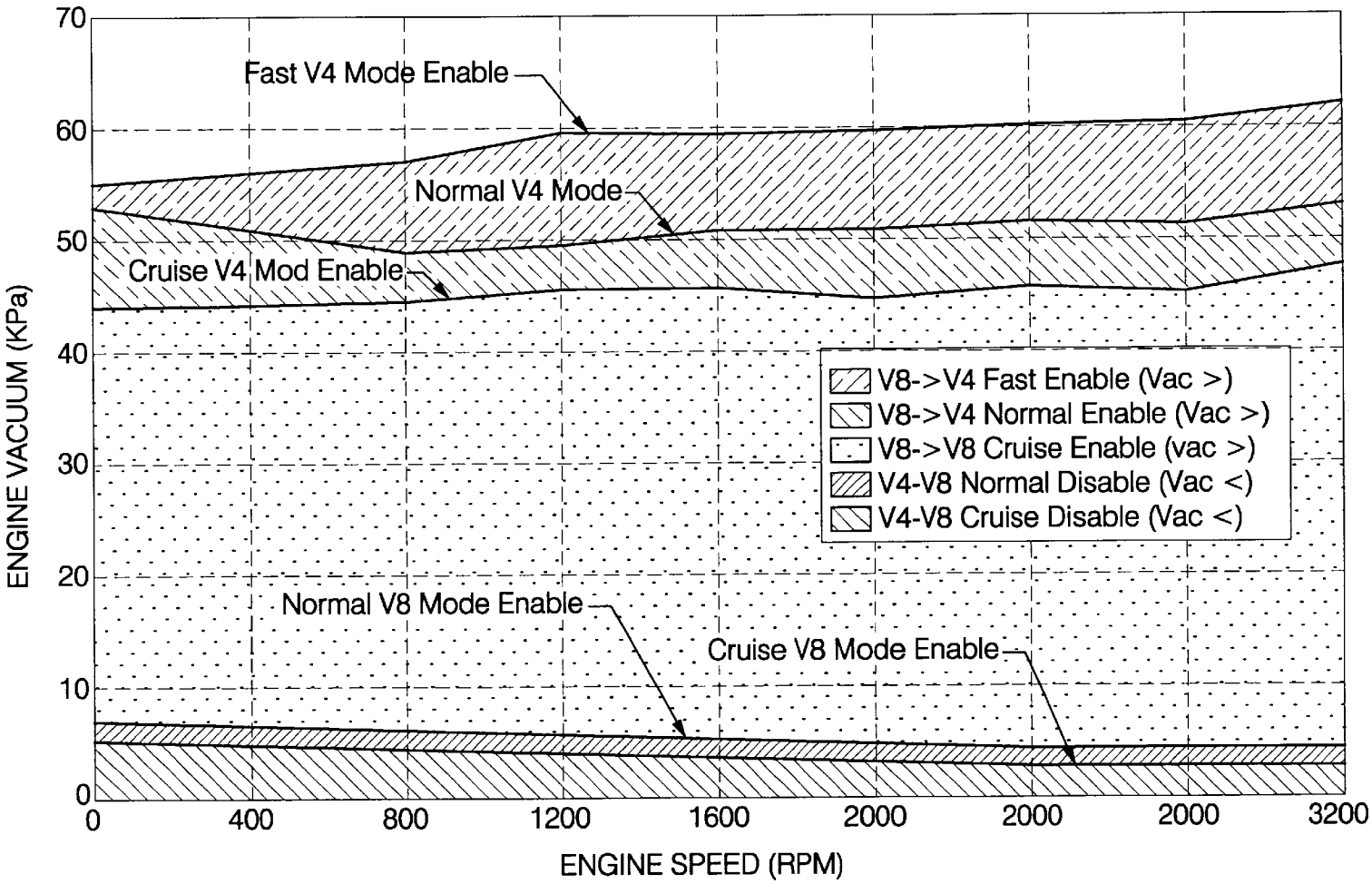
FIG. 3 is a graph of the different operating conditions of the present invention.

Referring to FIG. 3, partial displacement and full displacement operating mode cycling are based primarily on engine vacuum hysteresis pairs, selected by mode and RPM. FIG. 3 illustrates the relationship between vacuum for the ICE 12 operating in a partially displaced and fully displaced mode or configuration.

Figure 4:
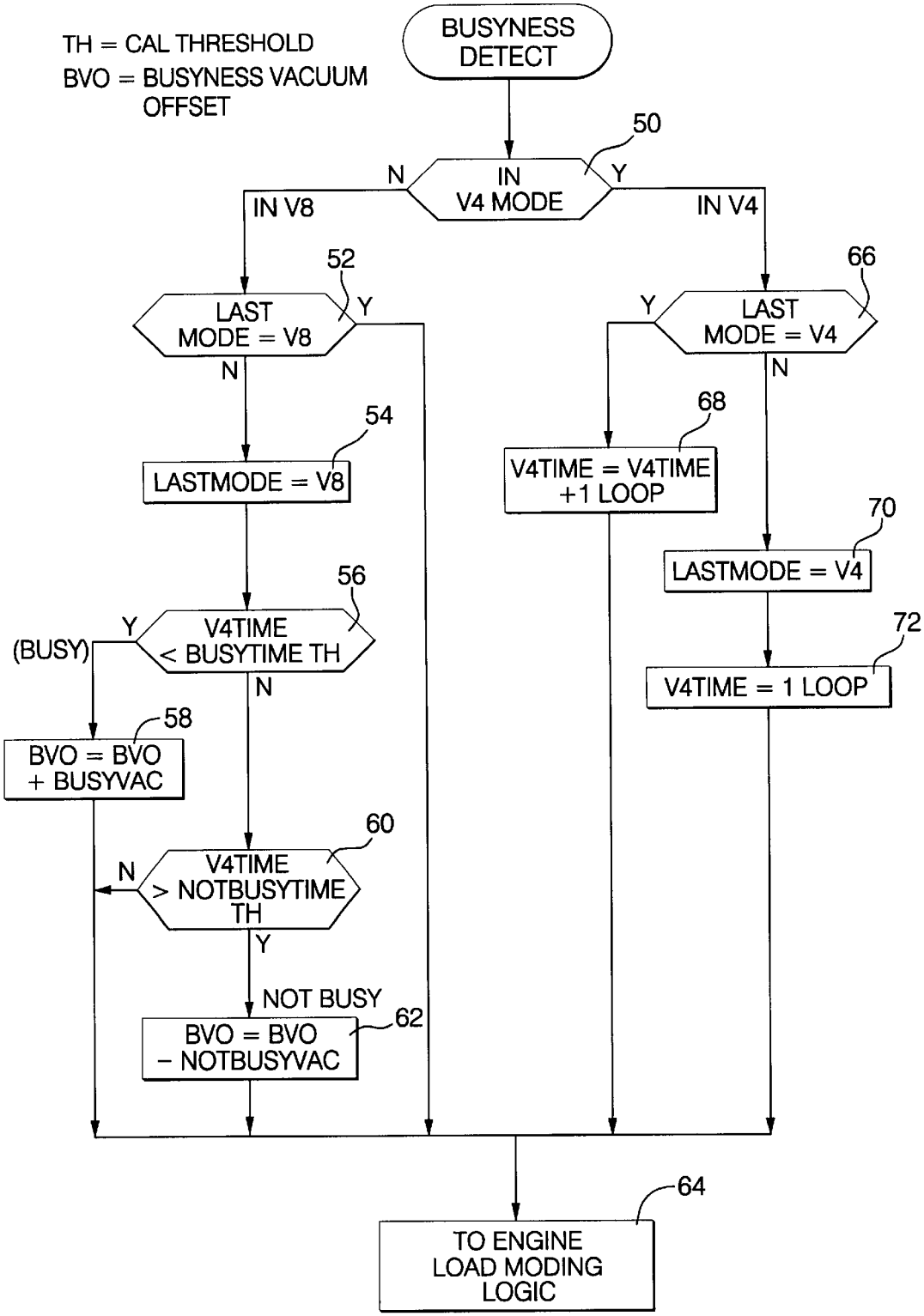
FIG. 4 is a flowchart for busyness detection based on engine vacuum.

To reduce the busyness or switching between a partially displaced (preferably four cylinders "V4" operating in an eight cylinder "V8" engine) and fully displaced mode, the busyness must be quantified. FIG. 4 is a flow chart detailing the detection of busyness in the present invention. Starting at block 50, the routine determines if the engine 10 is in V4 or V8 mode. If the engine 10 is not in V4 mode, the routine continues to block 52 where it is determined if the last mode was V8 mode. If the engine was not in V8 mode the last loop, the LastMode is set to V8 in block 54 and the busyness vacuum offset can be updated based on the time in V4 mode. The counter V4Time is the continuous time (in 12.5 msec loops) spend in V4 mode before switching to V8 mode. If the V4Time is less than the BusyTime_Threshold, as determined in block 56, the system is determined to be "busy" and the Busyness Vacuum Offset is increased in block 58 by the amount of the calibration, BusyVacuum. If the V4Time is greater than the NotBusyTime Threshold, as determined in block 60, the system is not busy and the Busyness Vacuum Offset is decreased in block 62 by the amount of the calibration, NotBusyVacuum. The routine will then continue to the engine load moding logic of block 64. If the LastMode was equal to V8, as determined in block 52, the routine will then continue to the engine load moding logic of block 64.

If the engine 10 is in V4 mode, as determined at block 50, then at block 66 the routine will determine if the LASTMODE was V4 mode. If the engine was not in V4 mode in the last loop as determined in block 66, the LastMode flag is set to V4 in block 70 which allows the routine to initialize the loop counter for V4Time to one loop (12.5 msec) in block 72 and the routine will continue to the engine load moding logic of block 64. If the LastMode was equal to V4 as determined in block 66, the loop counter V4TIME is incremented by one loop time and the routine continues to the engine load moding logic of block 64. The method illustrated in FIG. 4 attempts to maximize the time the ICE 12 is in a partially displaced operating configuration and to reduce busyness.

The present invention uses three calibration tables for vacuum thresholds versus engine speed for V8→V4 moding and two calibration tables for V4→V8 moding. If the vacuum exceeds the V8→V4 threshold calibration for a variable consistency time, the engine load is low enough to be commanded to switch to partial displacement. The consistency time varies with the difference between the measured vacuum and the threshold to require longer consistency times when nearer the threshold. When the vacuum is less than the V4→V8 threshold calibration, the engine load is too high for partial displacement, and the engine is commanded to switch to full displacement.

Figure 5:
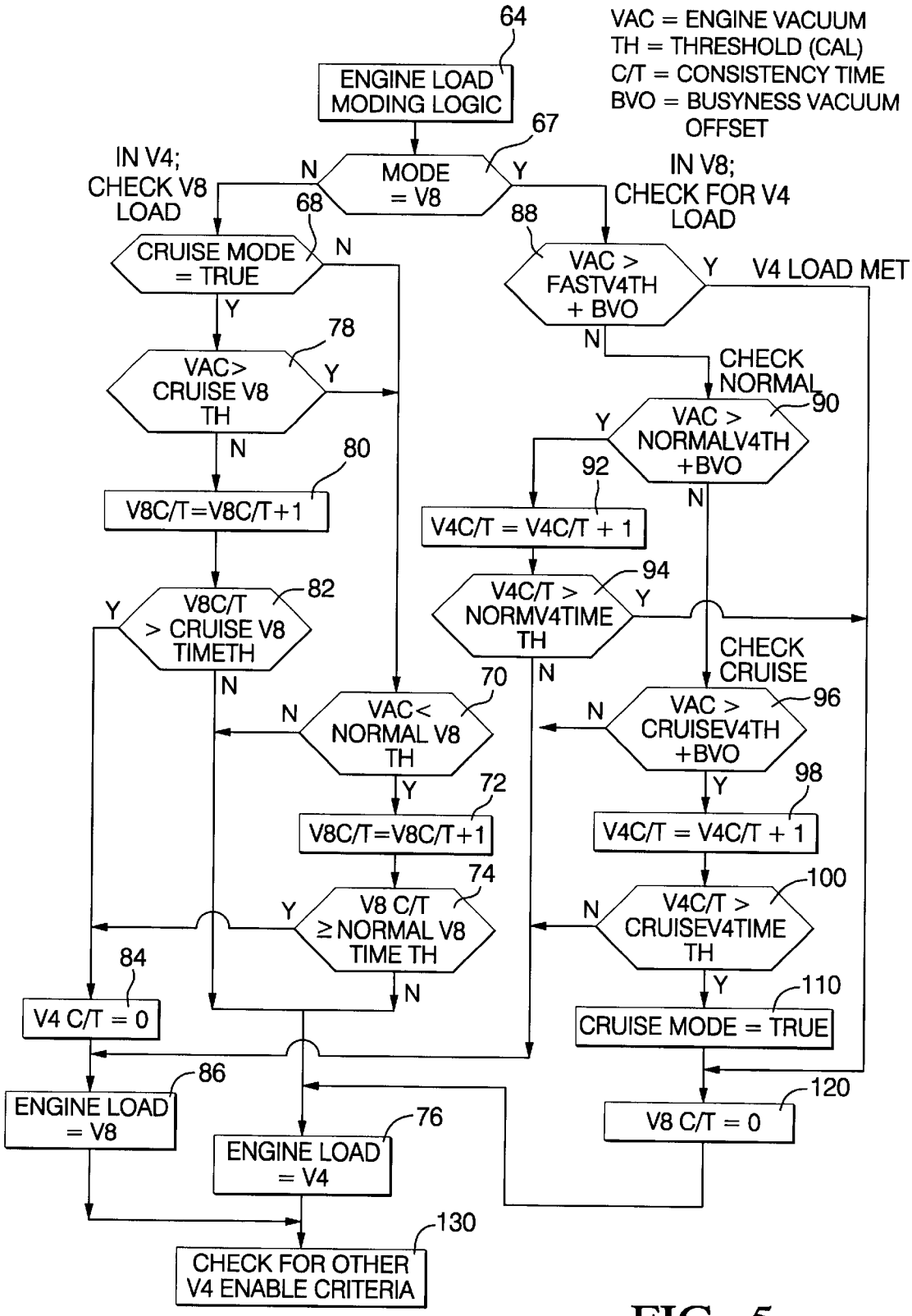
FIG. 5 is a flowchart for engine load moding based on engine vacuum.

FIG. 5 illustrates the engine load moding logic of the present invention. At block 67 the routine determines if the engine 10 is in a V8 operating mode. If the engine 10 is not in a V8 mode, then the routine at block 68 determines if the vehicle is in cruise mode. If the vehicle is not in cruise mode, then at block 70, if the routine determines the vacuum is less than the Normal_V8_Threshold calibration, it will increment the V8_Consistency_Time in block 72 by one loop time. Then proceeding to block 74, if the V8_Consistency_Time is determined to exceed a calibration value for Normal_V8_Time_Threshold, the V4_Consistency_Time is set to zero in block 84 and the routine proceeds to block 86 to set the Engine_Load to V8. The routine proceeds to block 130 to check for other V4 mode enable criteria. Returning to block 74, if the V8_Consistency_Time is determined not to exceed a calibration value for Normal_V8_Time_Threshold, the routine sets the Engine_Load to V4 in block 76 and proceeds to block 130 to check for other V4 mode enable criteria. Returning to block 70, if the vacuum was determined to not be less than the Normal_V8_Time_Threshold, the routine proceeds to execute the routines in block 76 and 130 described above. Returning to block 68, if the routine determines that cruise mode is true, the routine proceeds to block 78 where if the vacuum is determined to exceed the calibration for Cruise_V8_Threshold, the routine proceeds to block 70 and executes the routine described above. If in block 78, the vacuum is determined to not exceed the Cruise_V8_Threshold, the routine increments the V8_Consistency_Time in block 80 and proceeds to block 82. If the V8_Consistency_Time is determined to exceed the Cruise_V8_Threshold time in block 82, the routine proceeds to block 84 and executes the routine described above. Otherwise, the routine proceeds to block 76 to execute the routines also described above.

Returning to block 67, if the engine is determined to be in V8 mode, the routine proceeds to block 88 where if the vacuum exceeds the Fast_V4_Threshold+Busyness_Vacuum_Offset vacuum threshold, the routine proceeds to block 120 to set the V8_Consistency_Time to zero and then proceeds to block 76 to run routine described above. Returning to block 88, if the vacuum does not exceed the threshold, the routine determines if the vacuum exceeds the Normal_V4_Threshold+Busyness_Vacuum_Offset in block 90 and if true, proceeds to block 92 to increment the V4_Consistency_Time by one loop time. Continuing from block 92, in block 94 if the routine determines that the V4_Consistency_Time exceeds the Normal_V4_Time_Threshold, it then proceeds to block 120 to run the routine described above. Returning to block 94, if time does not exceed the threshold, the routine proceeds to block 86 to run the routine described above. Returning to block 90, if the vacuum was determined not to exceed the threshold, the routine proceeds to block 96 and determines if the vacuum does not exceed the cruise vacuum threshold of Cruise_V4_Threshold+Busyness_Vacuum_Offset and proceeds to block 86 as described above. If the vacuum did exceed the threshold in block 96, the routine increments the V4_Consistency_Time in block 98 and continues to block 100 where it determines if the V4_Consistency_Time exceeds the Cruise_V4_Time_Threshold in block 100. If true, the routine proceeds to block 110 to set Cruise_Mode to True and then to blocks 120 and 76 as described above. Returning to block 100, if the time did not exceed the threshold, the routine proceeds to block 86 to run the routine described above.

Other operating criteria include entering the V8 operating mode when a large change in accelerator pedal position (a large torque request) has been detected or the accelerator is near a fully depressed value. V4 mode may only be allowed within a calibrated range of voltage, oil pressure, oil temperature, engine speed and coolant temperature in the preferred embodiment of the present invention. Cylinder deactivation faults will also prevent V4 mode operation. To improve launch and driveability, the V4 operating mode may be limited to only high gears. Towing mode, engine protection factors, and certain engine control system component faults may also prevent the V4 operation.

While this invention has been described in terms of some specific embodiments, it will be appreciated that other forms can readily be adapted by one skilled in the art. Accordingly, the scope of this invention is to be considered limited only by the following claims.

What is claimed is:

1. An engine control system in a vehicle comprising:

a variable displacement internal combustion engine;

an intake manifold coupled to said variable displacement internal combustion engine;

a controller for controlling the displacement of said variable displacement internal combustion engine;

a pressure sensor sensing manifold pressure, said pressure sensor electronically coupled to said controller; and wherein said controller receives pressure information from said pressure sensor and changes the displacement of said variable displacement internal combustion engine in response to said pressure information.

2. The engine control system of claim 1 wherein said variable displacement internal combustion engine is a gasoline engine.

3. The engine control system of claim 1 wherein said variable displacement internal combustion engine is an eight-cylinder engine.

4. The engine control system of claim 1 wherein said manifold pressure is representative of torque for said variable displacement internal combustion engine.

5. The engine control system of claim 1 further including an electronic throttle operatively coupled to said variable displacement internal combustion engine.

6. A method of controlling the displacement of a variable displacement internal combustion engine comprising the steps of:

measuring a variable indicative of torque for a variable displacement internal combustion engine;

generating a torque threshold that indicates a torque condition to vary the displacement of the variable displacement internal combustion engine;

filtering the variable to delay a change in the displacement of the variable displacement internal combustion engine; and varying the displacement of the variable displacement internal combustion engine with reference to the filtered variable.

7. The method of claim 6 wherein the variable is vacuum pressure in said internal combustion engine.

8. The method of claim 6 wherein the variable is a measured torque output of the variable displacement internal combustion engine.

9. A method of controlling the displacement of a variable displacement internal combustion engine comprising the steps of:

measuring torque for a variable displacement internal combustion engine;

generating a torque threshold that indicates a torque condition to vary the displacement of the variable displacement internal combustion engine;

measuring a first time period that the torque has achieved the torque threshold; and varying the displacement of the variable displacement internal combustion engine when the measured time period has exceeded a second time period.

10. The method of claim 9 further comprising the step of varying the second time period with respect to the frequency of varying the displacement of the variable displacement internal combustion engine.

11. The method of claim 9 wherein the step of varying the second time period comprises varying the second time period to reduce the frequency of varying the displacement of the variable displacement internal combustion engine.

* * * * *